US005312055A

United States Patent [19]

Barthelmess et al.

[11] Patent Number: 5,312,055

[45] Date of Patent: May 17, 1994

[54] METHOD FOR THE OPERATION OF A STIRRING BALL MILL AND A STIRRING BALL MILL FOR THE PRACTICE OF THE METHOD

[75] Inventors: Ulrich Barthelmess; Ulrich Schindler, both of Niederstotzingen, Fed. Rep. of Germany

[73] Assignee: Omya GmbH, Cologne, Fed. Rep. of Germany

[21] Appl. No.: 934,422

[22] Filed: Aug. 24, 1992

[30] Foreign Application Priority Data

Aug. 23, 1991 [DE] Fed. Rep. of Germany ..... 4128074

[51] Int. Cl.[5] ..... B02C 17/22; B02C 17/24

[52] U.S. Cl. ..... 241/172; 241/180; 241/183

[58] Field of Search ..... 241/30, 171, 172, 180, 241/183

[56] References Cited

U.S. PATENT DOCUMENTS

| | | | |
|---|---|---|---|
| 2,560,972 | 7/1951 | Martin | 241/171 X |
| 2,592,994 | 4/1952 | Ahlmann | 241/172 X |
| 3,233,835 | 2/1966 | Sevin et al. | 241/171 X |
| 3,307,792 | 3/1967 | Hughes et al. . | |
| 4,059,232 | 11/1977 | Engels | 241/172 X |
| 4,998,678 | 3/1991 | Durr | 241/171 |
| 5,011,089 | 2/1991 | Vock et al. | 241/30 X |

FOREIGN PATENT DOCUMENTS

| | | | |
|---|---|---|---|
| 214145 | 3/1987 | European Pat. Off. . | |
| 2047244 | 3/1981 | Fed. Rep. of Germany | 241/172 |
| 2015544 | 4/1970 | France . | |
| 413795 | 5/1966 | Switzerland . | |
| 7297 | of 1893 | United Kingdom | 241/171 |

*Primary Examiner*—Mark Rosenbaum
*Assistant Examiner*—Frances Han

[57] ABSTRACT

The invention relates to a method of operating a stirring ball mill which has a preferably cylindrical, rotating barrel provided with an inlet at one end and an outlet at the other end, in which a stirring shaft provided with stirring means rotates. This method includes operating the mill at supercritical rotatory speed with a degree of fill of at least 25%, while the balls are retained in the mill. In this manner a great throughput is achieved and a narrow grain size range, without requiring a great amount of space.

5 Claims, 3 Drawing Sheets

METHOD FOR THE OPERATION OF A STIRRING BALL MILL AND A STIRRING BALL MILL FOR THE PRACTICE OF THE METHOD

BACKGROUND OF THE INVENTION

1. Field of the Invention

The invention relates to a method for the operation of a stirring ball mill having a preferably cylindrical, rotatable barrel with an inlet at its one end and an outlet at its other end, in which a stirring shaft provided with stirring means is rotatable, and to ball mills with stirring mechanism especially for this method.

2. Description of the Related Art

U.S. Pat. No. 2,592,994 disclosed back in 1952 a stirring ball mill in which the rotor—or also the barrel of the mill—rotates at such a speed that the entire bed of the mixture being ground is forced against the inner wall of the barrel due to the effect of the centrifugal force. At the same time it is desirable for the bed layer to be thin. On account of this uniform distribution of the bed in a thin layer over the entire inside wall of the barrel, it is said that a correspondingly uniform fineness is obtained at the output, but the grinding action and especially the throughput are too low in relation to the size and complexity of the apparatus. It is also disadvantageous that the balls are discharged from the mill together with the material suspension and have to be separated from the suspension outside of the mill, and then they are put back into the mill.

Apparently it is substantially for these reasons that this mill has found no practical application.

Stirring ball mills have proven practical which have stationary, vertically disposed, cylindrical barrels in which a vertical stirring shaft equipped with grinding disks is disposed; such a mill is disclosed, for example, in U.S. Pat. No. 2,855,156.

Depending on the height of these mills and the specific weight of the bed of the mixture being ground, a high hydrostatic pressure, diminishing upward from the bottom, prevails in the barrel of the mill. Accordingly, the grinding is performed under a relatively high grinding pressure that is especially high in the bottom area.

More precise studies, however, have shown that 95% of the material being ground is at the final degree of fineness at $\frac{1}{4}$ to $\frac{1}{3}$ of the height of the mill (measured from the inlet down); the upper $\frac{2}{3}$ to $\frac{3}{4}$ of the height of the mill therefore contributes hardly at all to the grinding action aside from the fact that this main part of the height of the mill is necessary in order to build up the hydrostatic pressure in the mainly effective bottom part of the height.

This relatively poor utilization of the capacity of the barrel is, of course, very unsatisfactory. Along with this is the fact that, when the mill is shut down, the bed of material separates so that the heaviest and coarsest parts sink downward. To restart the mill, therefore, a very great amount of power is needed, i.e., the drive system must be designed for this great initial power, which afterward is not utilized during normal operation.

Furthermore, on account of the compactness if the bed, these mills tend to clog from heat, so that the output of the mill is limited.

In European Patent B1 0 214 145 a dispersion method and stirring ball mill with a stationary barrel has been disclosed, in which the rotors revolve at such a high speed that, due to the centrifugal force, the balls form a rotating charge which also lies against the inside wall of the barrel, while in the center of this charge of balls a substantially free space develops. The barrel of the mill has a plurality of inlets distributed over its axial length, through which the material to be ground is distributed over the axial length and the charge of balls flows radially from the outside in against the centrifugal action such that, with respect to the balls, a centrifugal fluid bed develops and the ground material is carried out from the ball-free space through a ball separating system. The material being dispersed therefore fills the entire interior space of the grinding barrel.

The particles of the material being ground pass on a radial (or spiral) path from the inlet to the sifter disposed in the center of the barrel. This essentially radial path is too short for a sufficient, uniform comminution, so that the material has to be passed several times through the mill.

Furthermore, the centrifugal fluid bed for which this proposal strives is doubtful insofar as the radially outwardly directed centrifugal force would counteract the inwardly directed force of the flow of the particles. The bed is, so to speak, loosened up, and no grinding pressure is obtained that would correspond to the centrifugal force being exerted.

On account of the thickness of the bed, this mill tends to clog due to heat, and this again limits the throughput of the mill.

Also, a relatively high circumferential velocity and thus a relative velocity between the stirrers and the housing is necessary, entailing high attrition and wear on balls, stirrers and walls.

SUMMARY OF THE INVENTION

The invention is addressed to the same problem as virtually any mill, namely that of achieving a maximum throughput while occupying a minimum of space and especially producing a narrow grain-size range in the fines.

The solution of this problem consists, in accordance with the invention, in the fact that a stirring ball mill of the kind described above is operated at supercritical rotatory speed (at which the centrifugal force overcomes the force of gravity) with a fill of about 25%, the balls being retained in the mill.

In contrast to the mill according to U.S. Pat. No. 2,592,994 mentioned in the beginning, a mill operated in accordance with the invention has a deep bed of the material being ground, extending preferably over $\frac{1}{3}$ to $\frac{2}{3}$ of the radius of the barrel from the outside in.

The centrifugal force then takes the place of (or is added to the) the force of gravity. Depending on the radial thickness of the bed, a high centrifugal force prevails which increases in the radially outward direction; to this increasing centrifugal force corresponds a high grinding pressure, which occurs in place of the hydrostatic grinding pressure based only on gravity in the conventional stirring ball mill according to U.S. Pat. No. 2,855,156.

This centrifugal grinding pressure can be adjusted in virtually any desired manner by regulating the rotatory speed. In contrast to the previously known mill mentioned above, it is equal over the entire length or height of the mill.

Unlike the mill according to EP 02 14 145 B 1, however, a large free internal space remains in the mill operated according to the invention, which serves above all for the removal of water vapor formed within the grind bed, so that no overheating can occur in the mill.

In this manner a high grinding output combined with a narrow grain-size range and compactness of construction is achieved on the basis of the invention.

During operation, a different layering of the bed forms according to density: a greater centrifugal force acts on the coarse and specifically heavier particles than acts on the smaller and lighter particles. The balls have a greater density than the material of the charge. Consequently a layer consisting mainly of balls deposits itself radially outwardly, directly against the barrel wall. As the radial distance inward therefrom the material being ground (especially the slurry) steadily increases. The coarser particles of the material move further in the radial outward direction than the finer particles.

The charge material with the still coarse particles therefore migrates by centrifugal force radially outward at first, where it is ground up by the greater grinding pressure produced by the greater centrifugal force.

The now smaller particles become displaced further inward, where they are further ground by the now lower grinding pressure. The grinding pressure is thus automatically adapted to the particle size: the coarser particles which need a greater grinding pressure at first migrate radially outward into the zone of greater grinding pressure, while the finer particles which require a lower grinding pressure, and for which a lower grinding pressure is better, are subjected to this lower grinding pressure in a radially further inward area.

Radially inward, concentrically within this grind bed composed of individual cylindrical zones according to specific weight, a free cylindrical or slightly conical hollow space is obtained. Into this hollow space gases, especially water vapor from the bed layers, can enter and then be removed from the mill. The bed is constantly cooled by this water vapor removed from it, so that the throughput can be increased without the danger of overheating, especially local overheating within the grind bed.

The operating method according to the invention is designed primarily for a continuous operation of horizontally disposed stirring ball mills in which the material being ground is continuously fed to the one end of the grinding barrel, preferably through a hollow shaft, and removed at the opposite end.

Fundamentally, however, the method of the invention can be used also in batch operations.

Also, vertically disposed stirring ball mills can be operated according to the invention. In that case the grinding pressure based on the hydraulic pressure is added to the grinding pressure based on centrifugal force, and the result is a grinding pressure in a downward and outward direction.

The stirrers of the stirring shaft are preferably disks provided with openings for the removal of water vapor.

Especially good results are obtained in the operation of a stirring ball mill in the manner of the invention, in which stirrers are also provided on the inner circumference of the barrel, in the form of concentric annular disks which are set between the stirrers of the stirring shaft, which also are formed by annular disks, and whose inside diameter is smaller than the outside diameter of the annular disks of the stirring shaft.

When operation starts, the mill is filled each time to the point where the inner cylindrical or conical surface of the grind bed layer will have a smaller inside radius than the inside radius of the grinding disks on the circumference of the barrel.

Now, since each annular disk on the barrel serves, so to speak, as a divider between two axially adjacent annular disks of the stirring shaft, no particles of the material being ground can move axially on a straight path from the inlet to the outlet, and all of the particles are obliged to move on a path along the shaft and around the annular disks of the barrel and stirring shaft. The time of stay in the barrel is lengthened by this much longer path. The distance covered by all particles is approximately the same. All particles are carried repeatedly through zones of greater centrifugal force (radially outward) and zones of lesser centrifugal force (radially inward). Overall, therefore, a uniform but intensive grinding action is obtained within a thick bed of material, i.e., a high output with a narrower grain size distribution in the discharged material. It is also advantageous that the balls are held back by the annular disks on the barrel, i.e., they can move but slightly in the axial direction, so that the problem of separating balls and ground material, which is difficult in practice, is eliminated.

BRIEF DESCRIPTION OF THE DRAWINGS

With the aid of the drawing, the method of the invention will be described, as well as a mill constructed especially therefor.

DETAILED DESCRIPTION OF THE PREFERRED EMBODIMENTS

Figure 1:
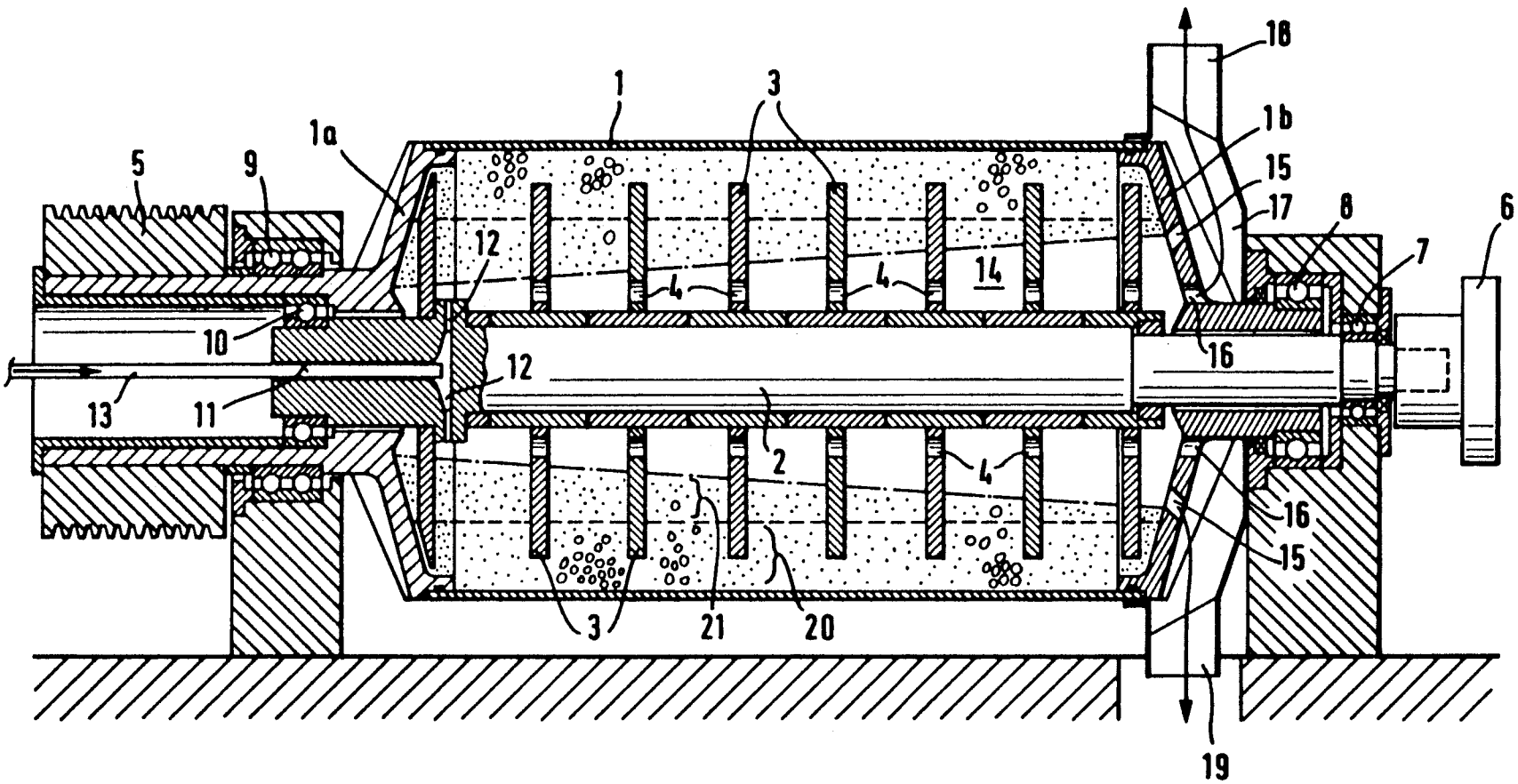
FIG. 1 is a longitudinal sectional view showing the conditions involved in the operation in accordance with the invention of a horizontal stirring ball mill.
Figure 2:
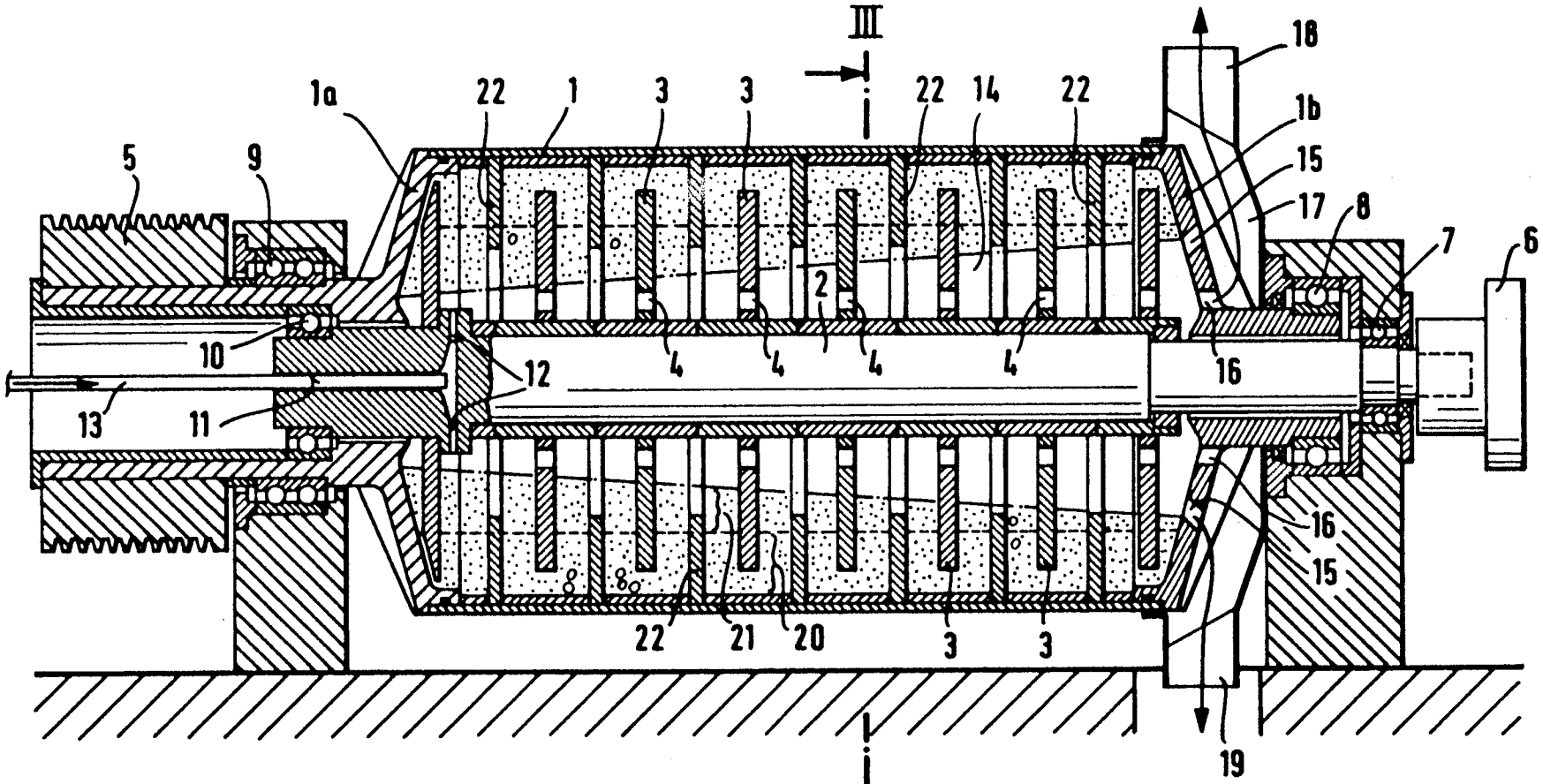
FIG. 2 is the same longitudinal sectional view as shown in FIG. 1 except that in FIG. 2 the circumference of the barrel is likewise provided in accordance with the invention with annular grinding disks.

Referring now to the drawings and in particular, FIGS. 1 and 2, the mill according to FIG. 1 and according to FIG. 2 consists essentially of a rotatable, multipartite barrel 1 and a stirring shaft 2 concentric therewith on which annular disks 3 are mounted at uniform distances apart. The annular disks 3 have openings 4 in their radially interior area for the escape of the water vapor forming within the bed.

The barrel and the stirring shaft are mounted at both ends on roller bearings 7, 8, 9 and 10. A belt pulley 5 is provided for the rotation of the barrel 1, and a coupling 6 is provided for driving the stirring shaft 2.

The stirring shaft 2 has at its one end 1*a* a central bore 11 which flares at its inside end, and is connected by at least one radial bore 12 to the grinding chamber. The suspension that is to be ground is pumped into the stirring ball mill through a feed tube 13 which is stationary and reaches through the bore 11 all the way into the area of the flare. The necessary amount of grinding balls has previously been put into the mill.

At the opposite end 1*b* of the barrel 1 there is at least one opening 15 as an outlet for the suspension, and also, radially within the suspension outlets 15, at least one opening for the vapor that forms.

These openings lead into a stationary receiving chamber 17 which has an outlet connection 18 on the top for the vapor and an outlet connection 19 on the bottom for the suspension.

The vapor openings 16 are uniformly distributed on a circle within the circle of the openings 15 for the suspension. The radial distance between the outlet openings 15 determines the fill level. Preferably this radial distance, and therefore the fill level, are adjustable. For this purpose the outlet openings 15 can be formed by radial slots in which shutters or the like are radially displaceable.

According to the invention the mill is operated at a supercritical speed with a charge level of at least 25%. On account of the centrifugal force a cylindrical layering is established. A radially outer zone 20 is filled mainly by grinding balls, while a radially inner zone 21 consists mostly of the suspension of material being ground. The radial thickness of the suspension (inner zone 21) decreases from the inlet to the outlet, i.e., due to the loss of flow pressure a gradient is formed toward the outlet openings 15. A corresponding conical inner space 14 is free of the balls and of the suspension.

The annular disks 3 on the stirring shaft 2 divide the mill into a number of sections or chambers which, however, are connected to one another at their radially outer area. The suspension of material must thus flow around these annular disks on a more or less meandering course from the inlet side to the outlet side, so that the intensity of the grinding action is at virtually the same level for all particles. In this manner a higher product quality is achieved. Also the additional stirrers of the barrel increase the power load and with it the throughput.

Figure 3:
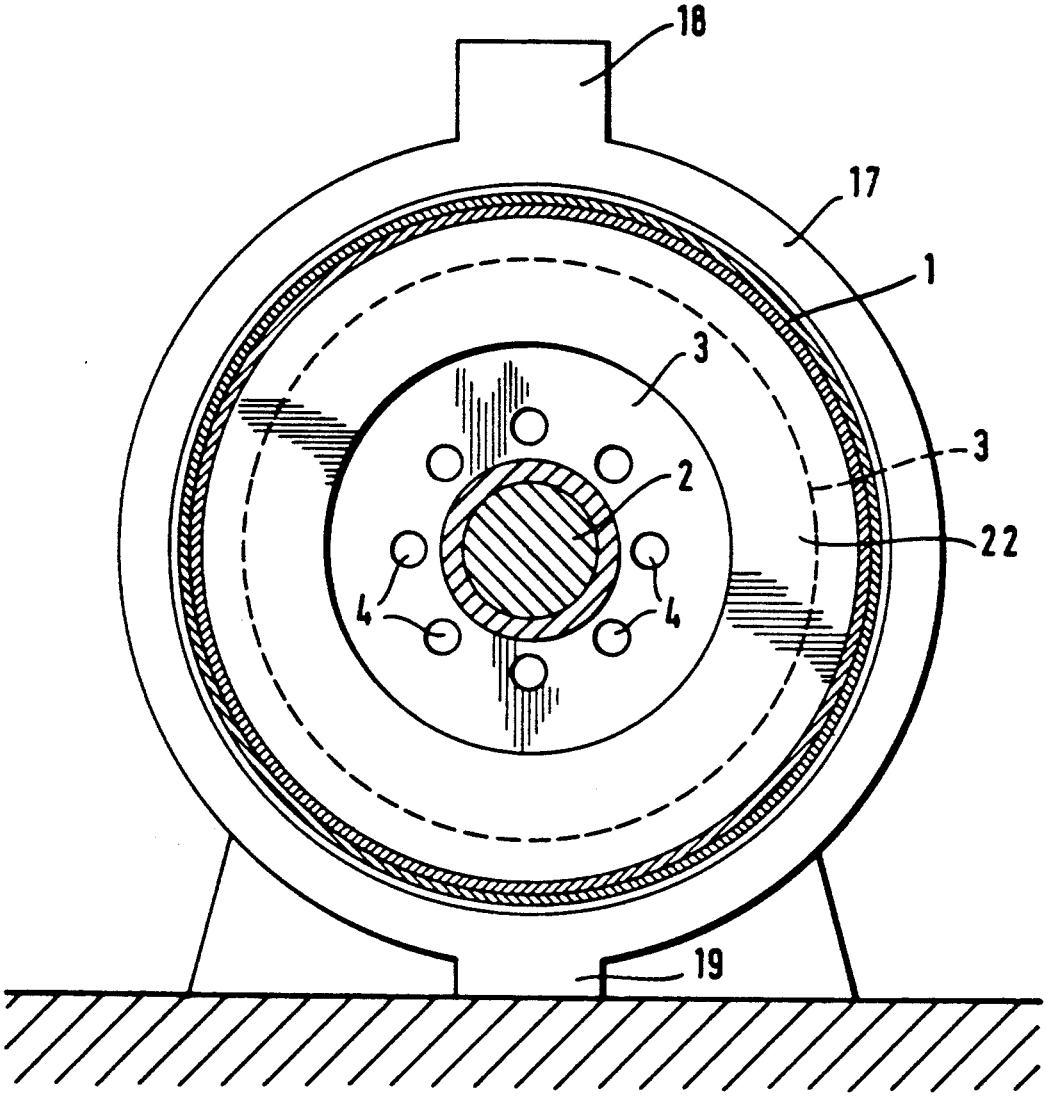
FIG. 3 is a sectional view along line III—III in FIG. 2.

In the case of the mill of FIGS. 2 and 3, stirrers are also provided on the inner circumference of the barrel 1. These stirrers consist of concentric rings or annular disks 22, which are disposed approximately centrally between the annular disks 3 of the shaft, and whose inside diameter is smaller than the outside diameter of the annular disks 3 of the stirring shaft 2.

These annular disks 22 on the barrel improve the division of the mill into a plurality of sections. The suspension of material is thus obliged to flow around these annular disks 22 on the inside of the barrel and the annular disks 3 of shaft 2 on a meander-like path from the inlet end to the outlet end. In this manner the grinding intensity is still further improved.

The additional stirrers on the barrel also increase the absorption of power and thus increase the throughput.

The water vapor is carried away through the above-mentioned openings 3 in the stirring rings 3, the vapor outlet openings 16 and the vapor outlet connections 18, and thus the mill is cooled. In this manner overheating of the mill is prevented in spite of the increased power absorption and the higher throughput resulting therefrom.

It is to be noted that the periphery of the barrel can be other than cylindrical, and can especially be of a conical or double-conical configuration.

We claim:

1. A stirring ball mill comprising a barrel having a generally cylindrical interior surface, the barrel having an inlet at its one end for input of a feed, an outlet means at its other end for withdrawal of a milled feed and gases, and first stirring means comprising annular outer disks on the interior surface of the barrel reaching radially inward and allowing for the passage of feed therearound;

means for rotating the barrel at supercritical speed; and a rotatable stirring shaft within the barrel and concentric therewith, the stirring shaft having second stirring means thereon comprising inner disks concentric with the stirring shaft reaching radially outward therefrom, the inner disks having an outer radius less than that of the barrel leaving an annular space therebetween for passage of feed, and the inner disks having passage openings to allow for the passage therethrough of gases, the passage openings being situated such that when the barrel is rotated at supercritical speed so as to centrifuge the particles therein, the passage openings are within a space within the barrel free of centrifuged particles to allow for the free passage of gases therethrough to said outlet means;

wherein the outer disks project between successive inner disks and the inner radius of the outer disks is less than the outer radius of the inner disks.

2. Stirring ball mill according to claim 1, wherein an end wall of the barrel at its outlet end is provided with outlet openings for gases.

3. Stirring ball mill according to claim 2, wherein the outlet means for the gases is formed by a series of openings in an end wall of the barrel at its outlet wall, the openings being uniformly distributed on a circle concentric with the axis of rotation of the barrel.

4. Stirring ball mill according to claim 1, wherein the outlet means for the milled feed is formed by a series of openings in an end wall of the barrel at its outlet end, the openings being uniformly distributed on a circle concentric with the axis of rotation of the barrel.

5. Stirring ball mill according to claim 4, wherein the outlet openings for milled feed are formed each by a radial slot in which a shutter is radially displaceable so as to allow for the varying of the size and the radial position of the openings.

* * * * *